US012553245B2

(12) United States Patent
Zhai

(10) Patent No.: US 12,553,245 B2
(45) Date of Patent: Feb. 17, 2026

(54) SNAP-IN MEMBER, ASSEMBLED DECKING COMBINATION AND METHOD OF ASSEMBLING DECKING

(71) Applicant: Feeling Wood Ltd, Houston, TX (US)

(72) Inventor: Bin Zhai, Wuhu (CN)

(73) Assignee: Feeling Wood Ltd, Houston, TX (US)

( * ) Notice: Subject to any disclaimer, the term of this patent is extended or adjusted under 35 U.S.C. 154(b) by 305 days.

(21) Appl. No.: 18/361,307

(22) Filed: Jul. 28, 2023

(65) Prior Publication Data

US 2025/0034883 A1 Jan. 30, 2025

(30) Foreign Application Priority Data

Jul. 26, 2023 (HU) ..... U2300133

(51) Int. Cl.
*E04F 15/02* (2006.01)
*E04B 1/00* (2006.01)

(52) U.S. Cl.
CPC ..... *E04F 15/02183* (2013.01); *E04B 1/003* (2013.01); *E04F 2201/0535* (2013.01)

(58) Field of Classification Search
CPC ..... E04F 15/02183; E04F 2015/02094; E04F 13/0826; E04F 2015/02122; F16B 5/002; E04B 1/003
See application file for complete search history.

(56) References Cited

U.S. PATENT DOCUMENTS 5,881,508 A * 3/1999 Irvine ..... E04F 15/10 52/579
8,955,281 B2 * 2/2015 Pietruczynik ..... B29C 48/175 52/630
2014/0318065 A1 * 10/2014 Torres-Pinzon ..... E04F 15/02044 52/489.2
2019/0309527 A1 * 10/2019 Bergelin ..... E04F 15/02044
2021/0388622 A1 * 12/2021 Vernon ..... E04F 15/02044

FOREIGN PATENT DOCUMENTS

| | | | | |
|---|---|---|---|---|
| CN | 208202454 U | | 12/2018 | |
| CN | 210369724 U | | 4/2020 | |
| CN | 216340633 U | * | 4/2022 | ..... E04F 15/02 |
| CN | 218779863 U | | 3/2023 | |
| DE | 202007002282 U1 | * | 6/2008 | ..... E04F 15/10 |
| DE | 202013010345 U1 | * | 1/2014 | ..... E04F 15/02183 |
| WO | WO-2015159136 A1 | * | 10/2015 | ..... E04F 15/02183 |
| WO | WO-2016083497 A1 | * | 6/2016 | ..... E04F 15/02044 |

* cited by examiner

*Primary Examiner* — Theodore V Adamos
(74) *Attorney, Agent, or Firm* — Nitin Kaushik

(57) ABSTRACT

Embodiments of the present invention disclose a snap-in member, an assembled decking combination and a member of assembling decking, relating to the field of decking assembling. Among them, the snap-in member comprises a first snap-in seat, a second snap-in seat and a connecting base; wherein the other side of said first snap-in seat is configured with a driving groove for driving the rotation of said first snap-in seat, said second snap-in seat and said connecting base, such that the first snap-in seat and the second snap-in seat are snapped into and limit a joist and a decking body, respectively. The present invention mounts two adjacent decking bodies on the same joist only by adjusting the angle of a snap-in member, which is simple and easy to operate and effectively improves the efficiency of installation and disassembly of decking bodies.

17 Claims, 15 Drawing Sheets

SNAP-IN MEMBER, ASSEMBLED DECKING COMBINATION AND METHOD OF ASSEMBLING DECKING

TECHNICAL FIELD

The present invention relates to the field of decking assembling, in particular a snap-in member, an assembled decking combination and a method of assembling decking.

BACKGROUND

At present, decking as a building decoration material has been widely applied in homes and various public places. The existing decking boards are generally flat strip decking boards. In order to reduce the direct contact between decking and ground moisture, a layer of joists is typically laid on the ground first, and then decking boards are laid on the joists in turn, wherein the decking boards are attached to the joists using screws and other detachable structures to secure the decking boards to the joists.

In the actual process of decking assembling and installation, decking boards are typically mounted onto joists using screws or bolts. This method is troublesome in the early installation and the later replacement, that is, the installation and disassembly of decking is less efficient.

SUMMARY

The objects of the present invention are to provide a snap-in member, an assembled decking combination and a method of assembling decking, for the purpose of solving the problems of less efficient decking installation and disassembly.

For solving the above-mentioned technical problems, the objects of the present invention are achieved through the following technical solutions. Provided is a snap-in member, comprising:

- a first snap-in seat, configured to extend along a first direction;
- a second snap-in seat, configured to extend along a second direction, wherein the first direction and the second direction are configured to have an angle of 70-90 degrees;
- a connecting base, the two ends of which are engaged to one side of the first snap-in seat and one side of the second snap-in seat, respectively;
- wherein, the other side of the first snap-in seat is provided with a driving groove for driving the rotation of the first snap-in seat, the second snap-in seat and the connecting base, such that the first snap-in seat and the second snap-in seat are snapped into and limit a joist and a decking body, respectively.

Embodiments of the present invention further provide an assembled decking combination, comprising:

- at least one snap-in member as described above;
- at least two decking bodies, wherein there is a gap spacing between the adjacent decking bodies, and two ends of each decking body are extendedly configured with a first snap-in groove along the length direction, respectively;
- at least one joist, each joist extendedly configured with a second snap-in groove along the length direction;
- wherein, all the decking bodies are laid on the joists; when the snap-in member is in the snap-in state, a first snap-in seat is snapped into the first snap-in groove, and the two ends of a second snap-in seat are snapped into two adjacent second snap-in grooves, respectively, so that the decking bodies are snapped into and limit the joists.

Embodiments of the present invention also provide a method of assembling decking, comprising:

- laying joists side by side on the ground in sequence along a third direction to form a joist skeleton;
- placing a first decking body on the front end of the joist skeleton along a fourth direction;
- inserting a second snap-in seat of each said snap-in member into a second snap-in groove from one end of said joist, and after said snap-in member slides to a preset position rotating said snap-in member such that the free end of a first snap-in seat in said snap-in member protrudes into a first snap-in groove of said decking body, and that said second snap-in seat in the snap-in member is snapped into the second snap-in groove;
- moving a second decking body along the third direction, so that the other free end of the first snap-in seat in the snap-in member protrudes into a first snap-in groove of the second decking body; and
- laying decking bodies in sequence according to the above steps.

The embodiments of the present invention provide a snap-in member, an assembled decking combination and a method of assembling decking. The embodiments of the present invention mount two adjacent decking bodies on the same joist only by adjusting the angle of a snap-in member, which is simple and easy to operate and effectively improves the efficiency of installation and disassembly of decking bodies: moreover, a certain gap spacing is left between decking bodies by mounting two adjacent decking bodies on the same joist using a snap-in member; and a snap-in member prevents two adjacent decking bodies from being squeezed with each other, so as to achieve the effect of reducing damage to decking bodies.

BRIEF DESCRIPTION OF DRAWINGS

To describe the technical solutions in the examples of the present invention more clearly, the following briefly describes the accompanying drawings required for describing the examples. Apparently, the accompanying drawings in the following description show merely some embodiments of the present invention, and a person of ordinary skill in the art may still derive other drawings from these accompanying drawings without inventive efforts.

Figure 1:
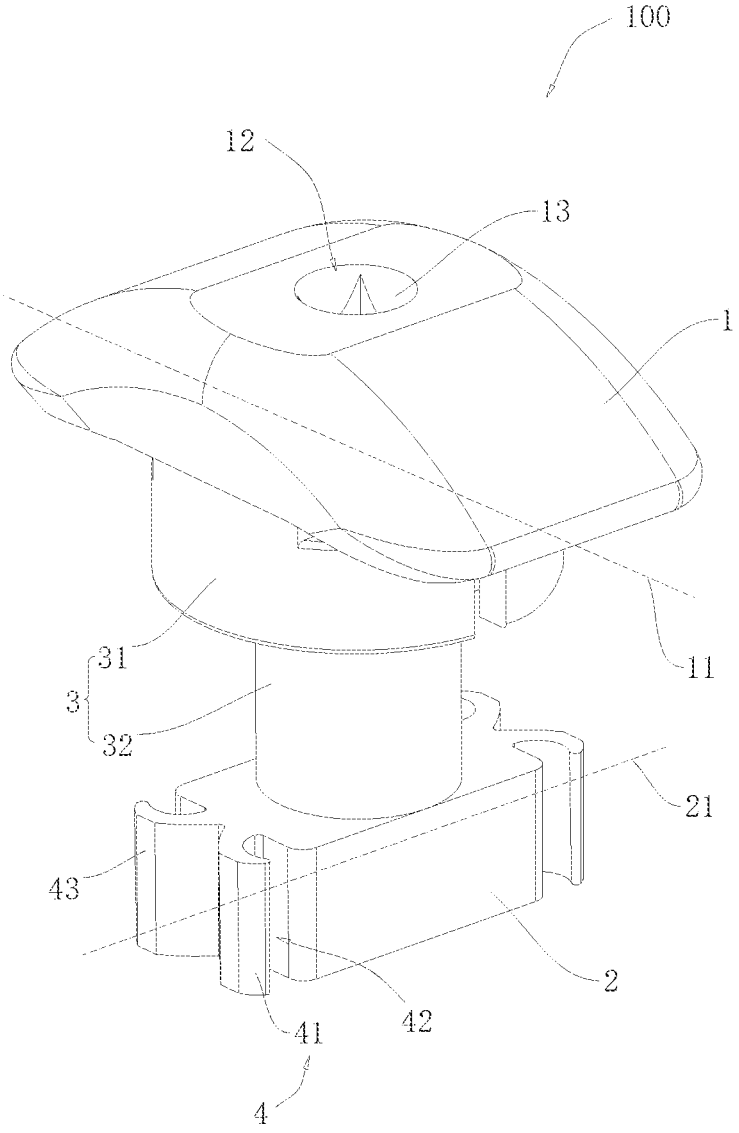
FIG. 1 is a schematic diagram of the snap-in member provided in Example 1 of the present invention in a first view angle.

Symbols in the drawings are explained as follows:

100. Snap-in member; 1. first snap-in seat; 11. first direction; 12. driving groove; 13. first guide slope; 2. second snap-in seat; 21. second direction; 3. connecting base; 31. abutting part; 311. first through hole; 312. first communication part; 313. second communication part; 314. third communication part; 32. connecting part; 4. deformation structure; 41. elastic piece; 42. deformation spacing; 43. abutting platform; 5. first surface; 51. second surface; 52. third surface; 53. fourth surface; 54. fifth surface; 55. second through hole; 6. decking body; 600. first snap-in groove; 61. protective layer; 62. hollow hole; 63. through groove; 7. joist; 700. second snap-in groove; 71. first mounting frame; 72. second mounting frame; 73. third mounting frame; 74. reinforcement groove; 75. first mounting block; 76. second mounting block; 77. third mounting block; 78. hollow groove; 8. hermetic structure; 81. blocking post; 82. third through hole; 83. flow channel; 84. elastic airbag; 9. third direction; 91. fourth direction; 92. arc-shaped projection; 93. gap spacing.

DETAILED DESCRIPTION OF THE EMBODIMENTS

The following clearly and completely describes the technical solutions in the examples of the present invention with reference to the accompanying drawings in the examples of the present invention. Apparently, the described examples are a part rather than all of the embodiments of the present invention. All other examples obtained by a person of ordinary skill in the art based on the examples of the present invention without inventive efforts shall fall within the protection scope of the present invention.

It should be understood that the terms "comprises" and/or "comprising," when used in this specification and the appended claims, specify the presence of described features, integrals, steps, operations, elements, and/or components, but do not preclude the presence or addition of one or more other features, integrals, steps, operations, elements, components, and/or combinations thereof.

It should also be understood that the terms used herein are for the purpose of describing particular examples only and are not intended to limit the present invention. As used in the specification and the appended claims of the present invention, the singular forms "a," "an" and "the" are intended to include plural referents unless the context clearly dictates otherwise.

It should be further understood that the term "and/or" used in the specification and the appended claims of the present invention refers to any and all combinations of one or more related listed items, including combinations thereof.

Example 1

Referring to FIG. 1-FIG. 4, the example of the present application provides a snap-in member, comprising:

- a first snap-in seat 1, configured to extend along a first direction 11;
- a second snap-in seat 2, configured to extend along a second direction 21, wherein the first direction 11 and the second direction 21 are configured to have an angle of 70-90 degrees;
- a connecting base 3, the two ends of which are engaged to one side of the first snap-in seat 1 and one side of the second snap-in seat 2, respectively;
- wherein, the other side of the first snap-in seat 1 is configured with a driving groove 12 for driving the rotation of the first snap-in seat 1, the second snap-in seat 2 and the connecting base 3, such that the first snap-in seat 1 and the second snap-in seat 2 are snapped into and limit a joist 7 and a decking body 6, respectively.

Figure 2:
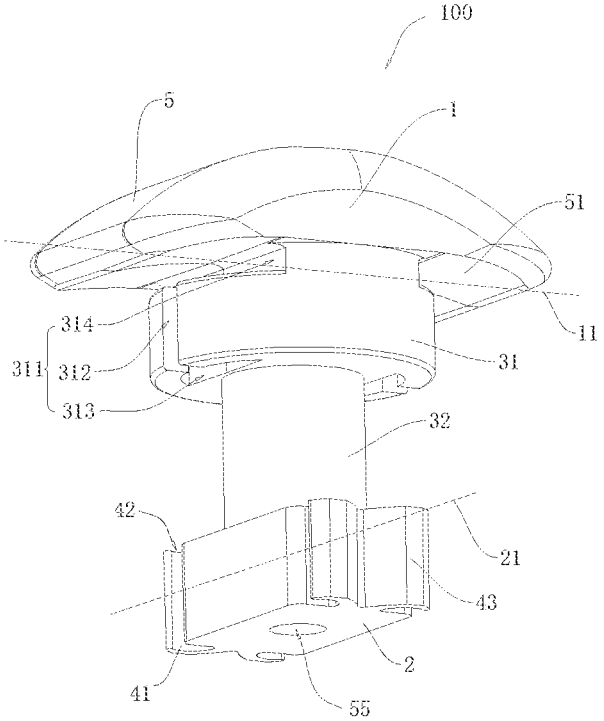
FIG. 2 is a schematic diagram of the snap-in member provided in Example 1 of the present invention in a second view angle.
Figure 3:
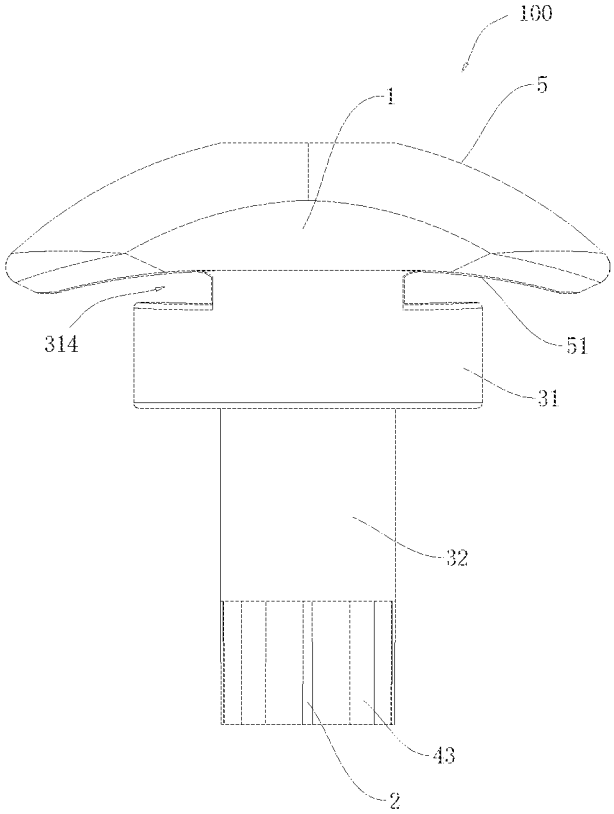
FIG. 3 is a projection diagram of the snap-in member provided in Example 1 of the present invention in a third view angle.

Referring to FIG. 1, FIG. 2 and FIG. 3, in this example, the first snap-in seat 1, the connecting base 3, and the second snap-in seat 2 are sequentially connected from top to bottom, wherein the connection mode includes but is not limited to welding, adhesion or integral molding; wherein, the length of the first snap-in seat 1, the second snap-in seat 2 and the connecting base 3 is not specifically defined in the present application. According to the actual structures of a second snap-in groove 700 of the joist 7 and a first snap-in groove 600 of the decking body 6, the actual length of the first snap-in seat 1, the second snap-in seat 2 and the connecting base 3 is configured. In other words, the snap-in member 100 of the present application is rendered better practicality and applicability.

In some embodiments, the angle between the first direction 11 and the second direction 21 is configured to be 90 degrees: after the second snap-in seat 2 is engaged into the second snap-in groove 700, the first snap-in seat 1 is not in contact with the decking body 6; and then the snap-in member 100 is driven to rotate by 90 degrees through the driving groove 12, so that the two ends of the first snap-in seat 1 are screwed into the first snap-in grooves 600 of the two adjacent decking bodies 6; in the meanwhile, the second snap-in seat 2 is also snapped into the second snap-in groove 700, so that the decking bodies 6 and the joists 7 are relatively secured.

In some embodiments, the driving groove 12 is positioned on the side facing away from the second snap-in seat 2, and the driving groove 12 is configured coaxially with the first snap-in seat 1, the second snap-in seat 2 and the connecting base 3; wherein the cross-sectional shape of the driving groove 12 includes, but is not limited to, a triangle, a quadrilateral and a hexagon, so as to facilitate the use of conventional tools, such as a hexagonal screwdriver, for driving the driving groove 12 to rotate. In some embodiments, the opening of the driving groove 12 is configured with a first guide slope 13 to play a role in guiding conventional tools.

Referring to FIG. 1, FIG. 2 and FIG. 3, in some embodiments, the connecting base 3 comprises an abutting part 31 and a connecting part 32, wherein the free end of the connecting part 32 is fixedly engaged with one side of the second snap-in seat 2, and the free end of the abutting part 31 is fixedly engaged with one side of the first snap-in seat 1:

wherein, the outer side of the abutting part 31 is configured to substantially abut against the opposite sides of two adjacent decking bodies 6 when the first snap-in seat 1 and the second snap-in seat 2 are in the snap-in state.

In this example, the cross-sectional area of the abutting part 31 is greater than that of the connecting part 32, so that when the connecting part 32 enters into the second snap-in groove 700, the abutting part 31 is limited by the joist 7 and will not be engaged into the second snap-in groove 700, thereby locating the position of the first snap-in seat 1 and guaranteeing that the first snap-in seat 1 can be smoothly screwed into the first snap-in groove 600 without interfering with the decking body 6.

Referring to FIG. 1, FIG. 2 and FIG. 3, in some embodiments, the connecting part 32 is present in a cylindrical shape, so that the snap-in member 100 reduces the squeeze friction between the connecting part 32 and the second snap-in groove 700 during the rotation process. Likewise, in some embodiments, the abutting part 31 is present in a cylindrical shape, so that the snap-in member 100 reduces the squeeze friction between the abutting part 31 and the decking body 6 during the rotation process;

In the manufacture, according to actual needs, the connecting part 32 and the abutting part 31 may also be configured in a prismatic shape.

In some embodiments, the outer peripheral side of the abutting part 31 may be in contact with the opposite sides of two adjacent decking bodies 6, so that when the decking bodies 6 are in a state of thermal expansion, part of the lateral force will be transmitted through the abutting part 31 to the joist 7.

In some embodiments, the abutting part 31 is configured with at least one first through hole 311 penetrating the outer side of the abutting part 31.

In this example, the first through hole 311 is configured such that the abutting part 31 has elastic deformation capability to some degree, and in the meanwhile the manufacturing materials of the abutting part 31 can also be saved.

Referring to FIG. 1, FIG. 2 and FIG. 3, in some embodiments, two first through holes 311 are symmetrically arranged, and the two first through holes 311 substantially face the opposite sides of the corresponding decking bodies 6 when the first snap-in seat 1 and the second snap-in seat 2 are in the snap-in state.

In this example, the two first through holes 311 are sequentially arranged along the first direction 11, so that after the first snap-in seat 1 is snapped into the corresponding position of the first snap-in groove 600, the two first through holes 311 face the opposite sides of the corresponding decking bodies 6 (that is, the sides of two adjacent decking bodies 6 close to each other).

Referring to FIG. 1, FIG. 2 and FIG. 3, in some embodiments, the first through hole 311 comprises the following parts that all penetrate the two sides of the abutting part 31:

a first communication part 312;

a second communication part 313, communicated with the first communication part 312; and a third communication part 314, communicated with the first communication part 312 and the second communication part 313, and positioned between the first snap-in seat 1 and the abutting part 31;

wherein, the first communication part 312 and the third communication part 314 are also communicated with the outer side of the abutting part 31, and the volume of the first communication part 312 is smaller than that of the second communication part 313.

In this example, the first communication part 312, the second communication part 313 and the third communication part 314 are in communication, so that the abutting part 31 forms two opposite arc-shaped projections 92. When the decking bodies 6 are in a state of thermal expansion, the arc-shaped projections 92 are deformed by the squeeze from the decking bodies 6, and recover as the shape of the decking bodies 6 recovers, playing a role in protecting both the snap-in member 100 and the decking bodies 6, and extending their service life.

Moreover, it should be understood that there are some processing errors in the process of producing decking bodies 6; that is, the width of decking bodies 6 may be greater, resulting in a smaller distance between two adjacent decking bodies 6. The arc-shaped projections 92 on the abutting part 31 may give rise to a certain deformation, that is, the two arc-shaped projections 92 are concave inwards to be adapted to the width of the decking body 6, thereby reducing the problem that the snap-in member 100 cannot relatively immobilize the joist 7 and the decking body 6.

In some embodiments, the two ends of the second snap-in seat 2 in the second direction 21 are configured with deformation structures 4, respectively, which are used to be snapped into and limit the second snap-in seat 2 and the joist 7 in the snap-in state.

In this example, as the second snap-in groove 700 is extendedly configured along the length direction of the joist 7, and the second snap-in seat 2 is slidable along the second snap-in groove 700 driven by an external force, in order to reduce undesired sliding, the present application uses the deformation structures 4 to limit the second snap-in seat 2 and the joist 7, thereby reducing undesired movement of the snap-in member 100.

Referring to FIG. 1, FIG. 2 and FIG. 3, in some embodiments, the deformation structure 4 comprises at least one elastic piece 41, one end of the elastic piece 41 securely engaged on one end of the second snap-in seat 2, and between the other end of the elastic piece 41 and the end face of the second snap-in seat 2 being a deformation spacing 42.

In this example, one end of the elastic piece 41 may be fixedly engaged to a section of the second snap-in seat 2 by means of integral molding. Due to the presence of the deformation spacing 42, the elastic piece 41 may suffer squeeze from the groove wall of the second snap-in groove 700 during the rotation and snap-in of the snap-in member 100, so that the deformation spacing 42 is reduced; that is, the elastic piece 41 abuts against the joist 7, thereby reducing undesired movement of the snap-in member 100.

In some embodiments, each deformation structure 4 comprises two symmetrically arranged elastic pieces 41, each of which is configured in an arc shape, and the outer side of each of which is provided with an abutting platform 43.

In this example, ends of the two elastic pieces 41 at the same side intersect to form one end and are fixedly engaged in the middle position of the second snap-in seat 2; the other ends thereof are configured to extend outward in the direction away from each other; and the elastic pieces 41 are configured in a radian, so that the two elastic pieces 41 of the same deformation structure 4 are present in a splayed shape, thereby improving the structural strength of the elastic pieces 41 and the second snap-in seat 2. Furthermore, as one side of the elastic piece 41 facing away from the second snap-in seat 2 is provided with an abutting platform 43 in the middle, when the snap-in member 100 is in the snap-in state, the abutting platform 43 abuts against the inner wall of the second snap-in groove 700, such that the contact area between the elastic piece 41 and the inner wall of the second snap-in groove 700 increases; that is, the friction strength between the elastic piece 41 and the joist 7 increases, thereby effectively improving the position-limiting stability of the joist 7 and the snap-in member 100.

In some embodiments, one side of the first snap-in seat 1 facing away from the second snap-in seat 2 is configured with an arched guide face, and one side of the first snap-in seat 1 facing the second snap-in seat 2 is configured with an outward arc face.

In this example, one side of the first snap-in seat 1 facing away from the second snap-in seat 2 is named as a first surface 5, and one side of the first snap-in seat 1 facing the second snap-in seat 2 is named as a second surface 51. The first surface 5 is a guide face and the second surface 51 is an arc face. The centers of the first surface 5 and the second surface 51 are on the same side, and positioned on the side of the first snap-in seat 1 facing the second snap-in seat 2. By the radian configuration of the first surface 5, it is convenient to take out the snap-in member 100 from the first snap-in groove 600; and by the radian configuration of the second surface 51, when facing undesired thickness of decking bodies 6 caused by processing errors the first snap-in seat 1 may utilize its own elastic deformation capability (both ends of the first snap-in seat 1 are bent in the direction away from the second snap-in seat 2) to be adapted to the first snap-in groove 600 of the decking body 6, thereby guaranteeing that the snap-in member 100 is smoothly engaged in the first snap-in groove 600.

In some embodiments, all edges of the first snap-in seat 1 are configured to be fillets so as to improve the grip comfort of the snap-in member 100.

Figure 4:
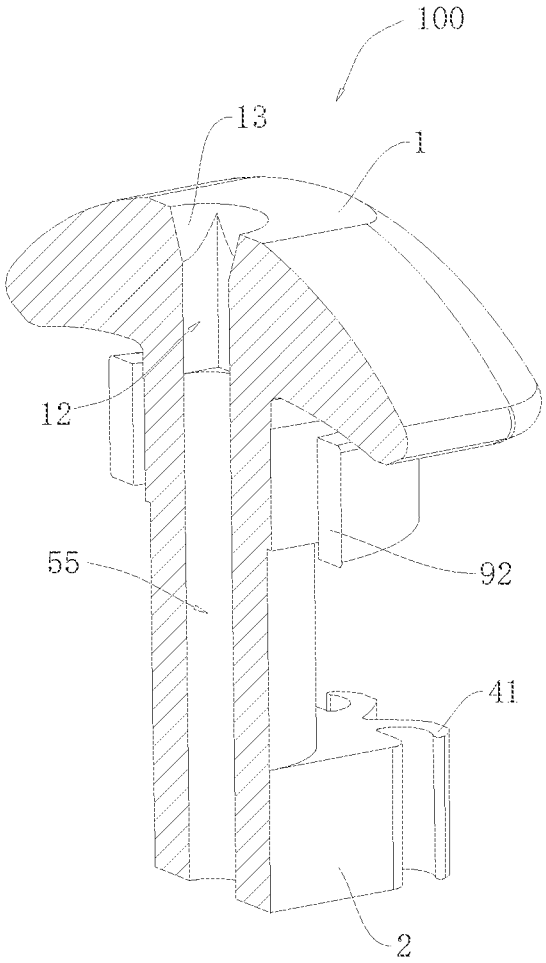
FIG. 4 is a cross-sectional diagram of the snap-in member provided in Example 1 of the present invention.
Figure 5:
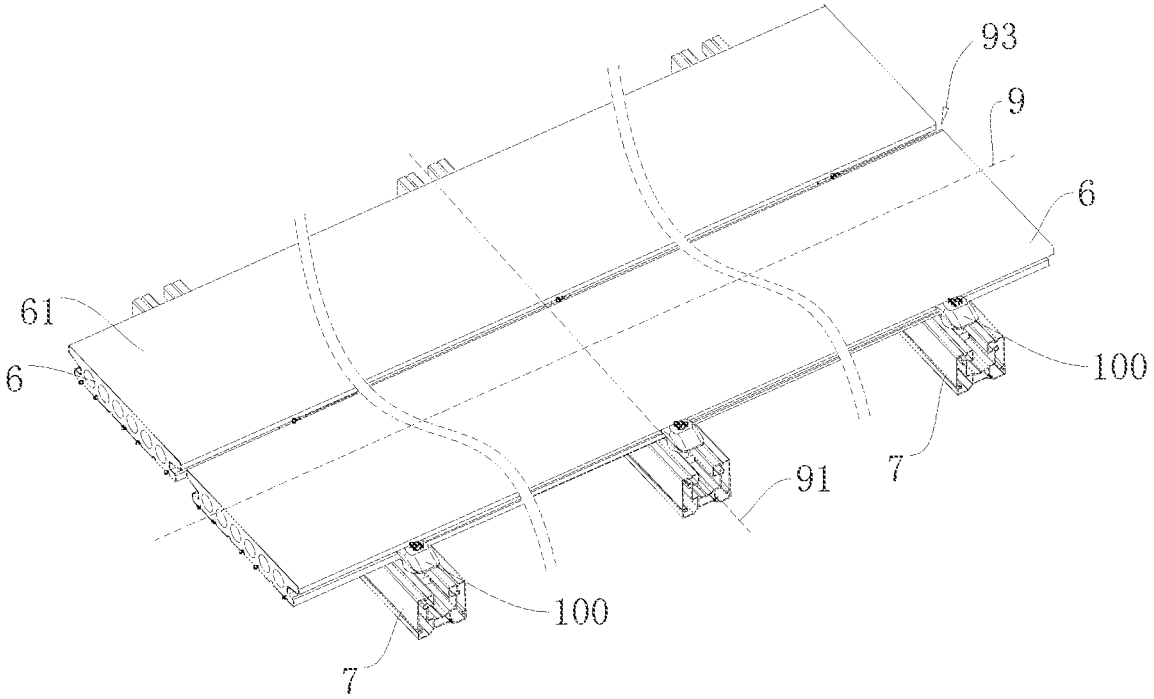
FIG. 5 is a schematic diagram of the assembled decking combination provided in Example 2 of the present invention in a first angle view.

Referring to FIG. 2 and FIG. 4, in some embodiments, the geometric centerlines of the first snap-in seat 1, the connecting base 3 and the second snap-in seat 2 coincide; and the first snap-in seat 1, the connecting base 3 and the second snap-in seat 2 are communicatively configured with a second through hole 55, which is coaxially communicated with the driving groove 12.

In this example, the second through hole 55 is communicated with the driving groove 12, and is used for passing tools such as a screw or an expansion screw or a bolt in some application scenarios, that is to say, a screw may be selected to immobilize the snap-in member 100 on the joist 7. When some longer decking bodies 6 are installed, or when decking bodies 6 are laid inclined or vertically, in order to improve the connection stability between joists 7 and decking bodies 6, screws or expansion screws or bolts may be used to immobilize snap-in members 100 on joists 7. It should be noted that if decking bodies 6 needs to be disassembled later, screws are used instead of bolts. And it should be noted that 1, 2 or 3 or other number of snap-in members 100 may be arranged between two adjacent decking bodies 6, and that these snap-in members 100 may be immobilized using 1, 2 or other number of screws, which is not specified in detail in the present application.

Moreover, as the snap-in member 100 is snapped into the joist 7, the extension line of the second through hole 55 is perpendicular to that of the joist 7, which ensures that a screw will not be obliquely screwed into the joist 7. It should be noted that the cross-sectional area of the second through hole 55 is smaller than that of the driving groove 12, so as to reserve a limiting position for the screw nut.

Example 2

Referring to FIG. 5-FIG. 11, the present application further provides an assembled decking combination, comprising:

at least one snap-in member 100 as described above;

at least two decking bodies 6, wherein there is a gap spacing 93 between the adjacent decking bodies 6, and the two ends of each decking body 6 are extendedly configured with a first snap-in groove 600 along the length direction, respectively;

at least one joist 7, each joist 7 extendedly configured with a second snap-in groove 700 along the length direction;

wherein, all the decking bodies 6 are laid on the joists 7; when a snap-in member 100 is in the snap-in state, a first snap-in seat 1 is snapped into the first snap-in groove 600, and the two ends of a second snap-in seat 2 are snapped into two adjacent second snap-in grooves 700, respectively, so that the decking bodies 6 are snapped into and limit the joists 7.

In this example, the first snap-in groove 600 comprises a third surface 52, a fourth surface 53 and a fifth surface 54 sequentially connected from top to bottom, wherein the length of the third surface 52 is greater than that of the fifth surface 54, and the third surface 52 is configured to incline in a direction away from the fifth surface 54 to be engaged with the first surface 5 of the snap-in member 100.

It should be noted that there is a gap spacing 93 between adjacent decking bodies 6 during the laying process, so as to be adapted to the deformation of the decking bodies 6 caused by thermal expansion and contraction, and to reduce damages when the two decking bodies 6 are squeezed. Moreover, a driving groove 12 is exposed through the gap spacing 93, which facilitates the later rotation of the snap-in member 100 using tools, thereby releasing the limiting relationship between the joists 7 and the decking bodies 6.

Figure 6:
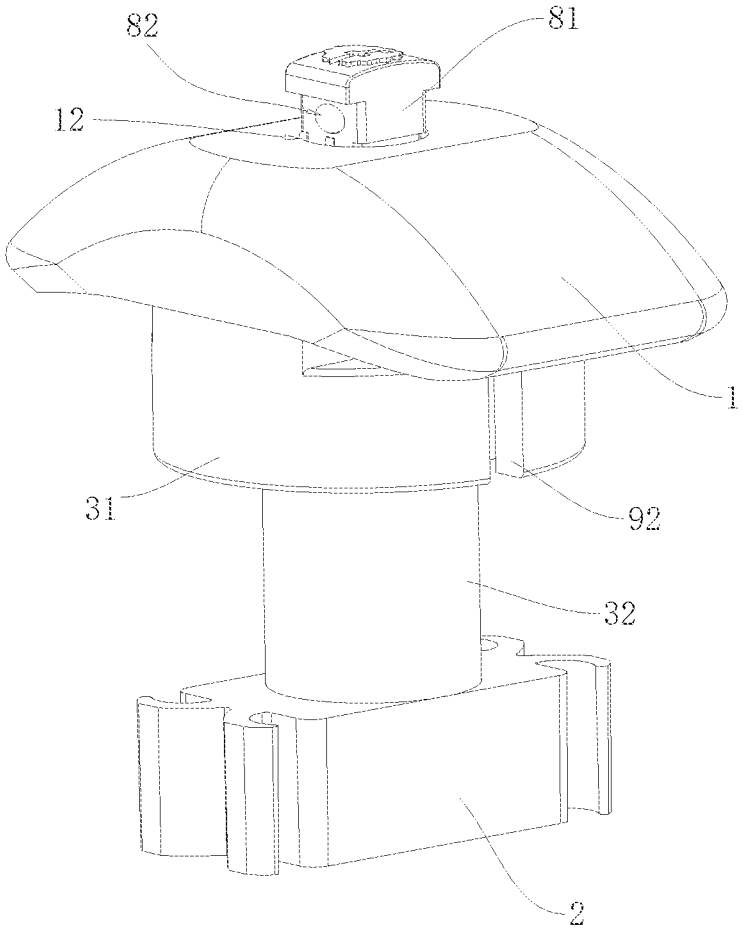
FIG. 6 is a schematic diagram of the assembled decking combination provided in Example 2 of the present invention, for showing a blocking post and a snap-in member.
Figure 7:
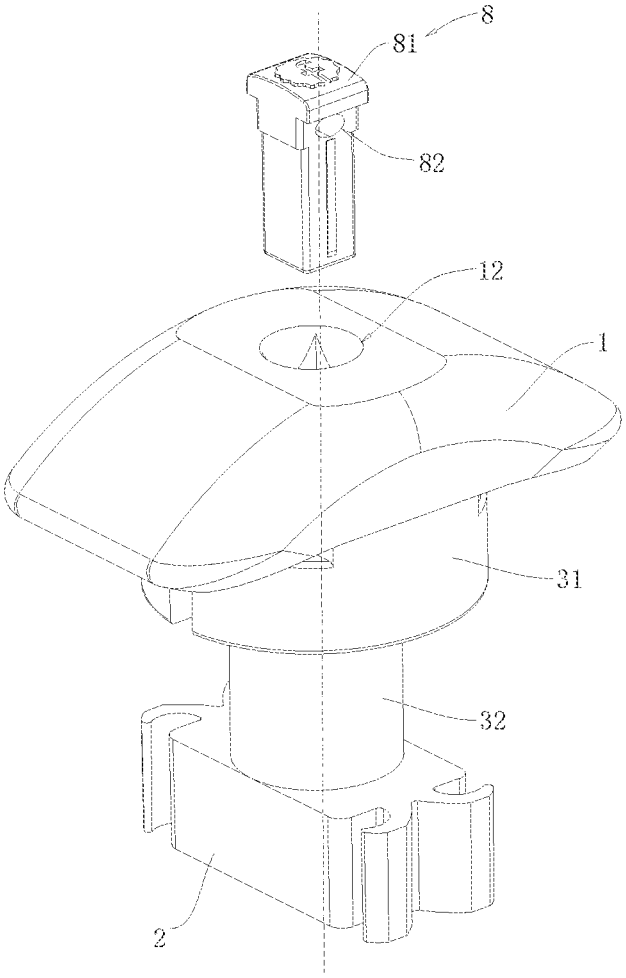
FIG. 7 is an exploded view of the assembled decking combination provided in Example 2 of the present invention, for showing a blocking post.

Referring to FIG. 6 and FIG. 7, in some embodiments, the assembled decking combination further comprises a hermetic structure 8 detachably mounted on the driving groove 12.

In this example, after decking bodies 6 are installed, some granular debris or dusts may be easily raised when users often step thereon. When these undesired debris and dusts fall into the driving groove 12, causing the driving groove 12 plugged and further giving rise to the need of replacing decking bodies 6 later, tools like wrenches cannot be inserted into the driving groove 12 to rotate the snap-in member. So the present application seals the driving groove 12 in advance by the presence of the hermetic structure 8, thereby preventing dusts or other debris from entering into the driving groove 12.

Figure 8:
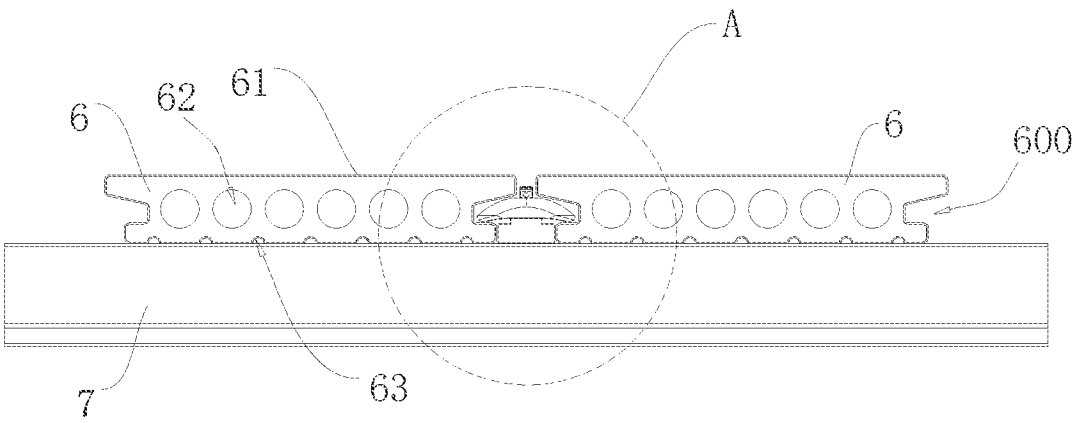
FIG. 8 is a schematic diagram of the assembled decking combination provided in Example 2 of the present invention in a second angle view.
Figure 9:
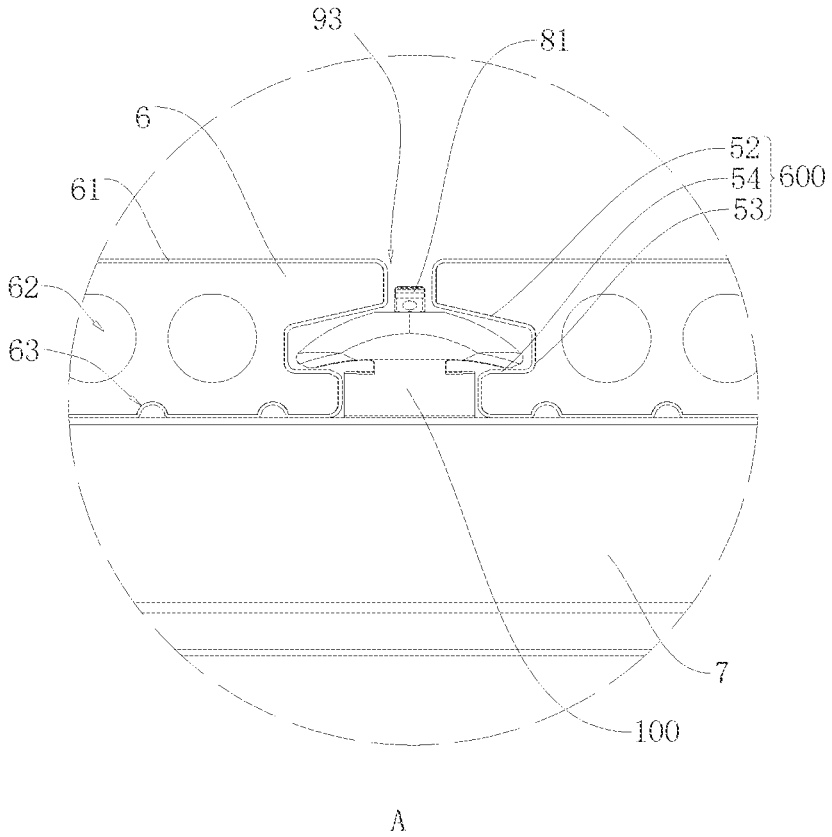
FIG. 9 is an enlarged view of part A in FIG. 8.

Referring to FIG. 7, FIG. 8 and FIG. 9, in some embodiments, the hermetic structure 8 comprises a blocking post 81, which is inserted into the driving groove 12 and has one end protruding from the opening of the driving groove 12 for sealing the driving groove 12 and for limiting two adjacent decking bodies 6.

In this example, the cross-section of the blocking post 81 is configured as a square; while in the manufacture, according to actual needs the shape of the blocking post 81 may also be a diamond, a circle, etc., which is not specifically defined in the present application. And the shape of the driving groove 12 is adapted to the shape of the blocking post 81.

In this example, one end of the blocking post 81 protrudes from the opening of the driving groove 12, which is beneficial to take out the blocking post 81. Because the blocking post 81 itself has a certain thickness and is positioned in the gap spacing 93 between two adjacent decking bodies 6, when the decking bodies 6 is in a state of thermal expansion the blocking post 81 will abut against two adjacent decking bodies 6, transmit the force generated by the decking bodies 6 to the snap-in member 100, and prevent the two decking bodies 6 from direct squeeze with each other, thereby playing a role in protecting the decking bodies 6.

Referring to FIG. 9, in some embodiments, the distance of one end of the blocking post 81 protruding from the opening of the drive groove 12 is less than the height of the upper surface of the decking body 6, so as to make the appearance good-looking and to prevent blocking post 81 from protruding the upper surface of the decking body 6 when the decking body 6 is in a state of thermal expansion and contraction.

The decking bodies 6 may cause the gap spacing 93 smaller during long-term use, and hence it is inconvenient to pull out the blocking post 81 from the driving groove 12. So in some embodiments, the protruding end of the blocking post 81 is configured with a third through hole 82, and one end of the blocking post 81 substantially abuts against one side of the decking body 6.

Referring to FIG. 6 and FIG. 7, in this example, when the blocking post 81 needs to be taken out, a tool such as a hook or iron wire may be directly inserted into the third through hole 82, so as to facilitate pulling out the blocking post 81 from the driving groove 12.

Referring to FIG. 8 and FIG. 9, in some embodiments, the decking body 6 is wrapped with a protective layer 61.

In this example, the protective layer 61 is used to protect the decking bodies 6, serving the purposes of oil and stain resistance, as well as anti-slip and waterproof.

Referring to FIG. 8 and FIG. 9, in some embodiments, the decking body 6 is configured with at least one hollow hole 62, and the side of the decking body 6 facing the joist 7 is configured with a plurality of through grooves 63.

In this example, the number of the hollow hole 62 may be set to 1, 2, 3, etc.; and the shape of the hollow hole 62 may be set to be circular, square, polygonal, waist-shaped, etc.; and the hollow hole 62 may be configured to penetrate through the decking body 6 in the length direction, or as an inner hole of the decking body 6, so that the weight of the decking body 6 is reduced.

Referring to FIG. 8 and FIG. 9, in some embodiments, the number of through grooves 63 may be set to 1, 2, 3, etc., and the through grooves 63 are extendedly configured along the length direction of the decking body 6 thereby playing the role of drainage and ventilation.

Figure 10:
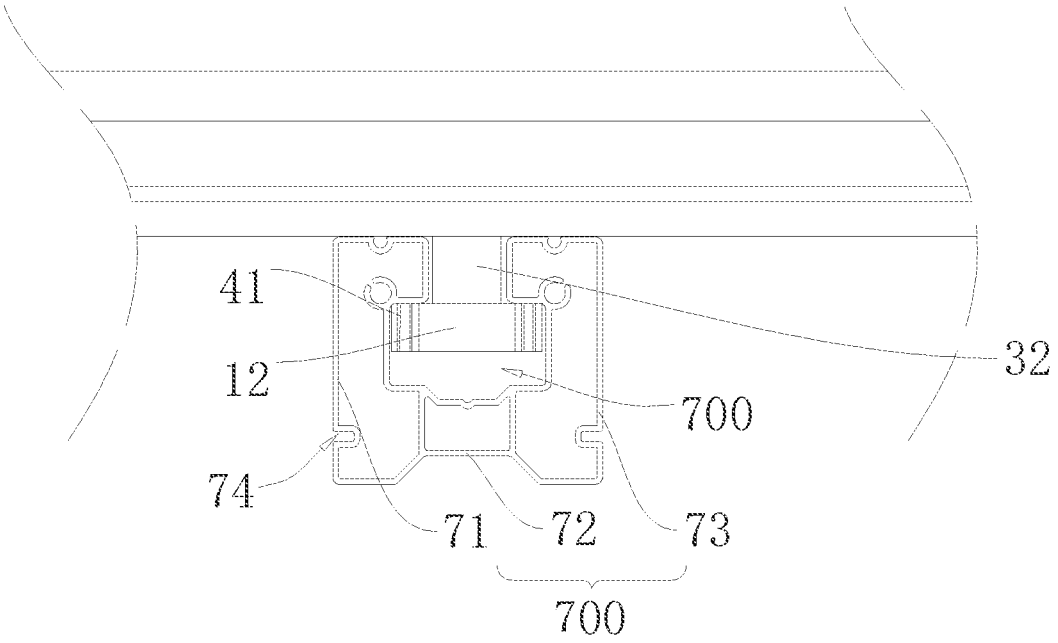
FIG. 10 is a schematic diagram of a local structure of the assembled decking combination provided in Example 2 of the present invention.
Figure 11:
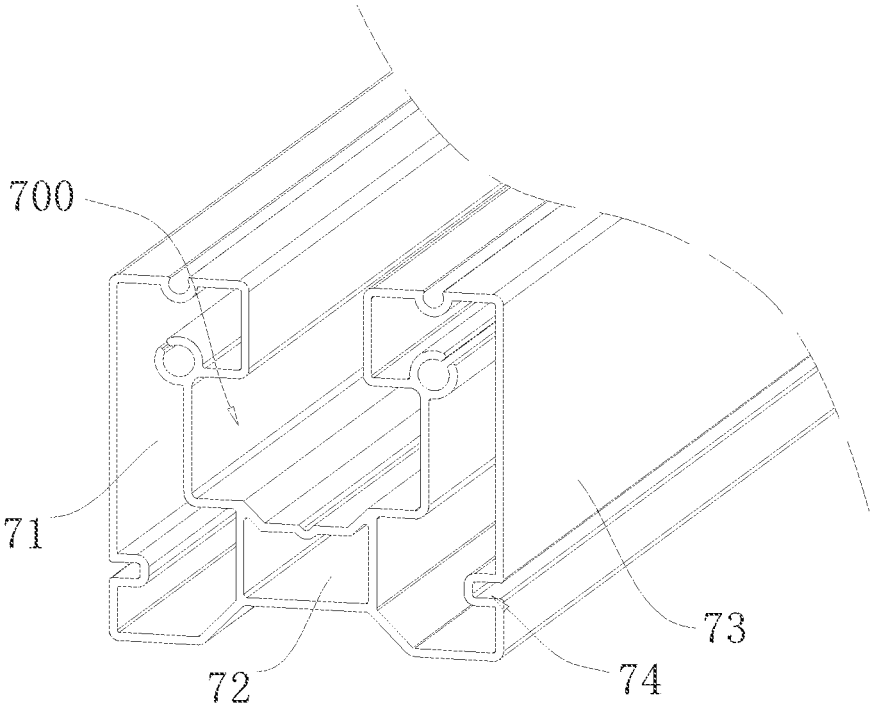
FIG. 11 is a schematic diagram of a local structure of joist in the assembled decking combination provided in Example 2 of the present invention.

Referring to FIG. 10 and FIG. 11, in some embodiments, the joist 7 comprises a first mounting frame 71 and a second mounting frame 72 that are configured symmetrically, wherein the first mounting frame 71 and the second mounting frame 72 are connected via a third mounting frame 73;

the first mounting frame 71, the second mounting frame 72 and the third mounting frame 73 surround to form a second snap-in groove 700;

wherein, both the first mounting frame 71 and the second mounting frame 72 are configured with at least one inward concave reinforcement groove 74.

In this example, the first mounting frame 71, the second mounting frame 72 and the third mounting frame 73 are configured to be integrally molded, thereby improving the structural strength of the joist 7, wherein the reinforcement groove 74 serves to reinforce the structural strength of the joist 7.

In some embodiments, the joist 7 may be a joist 7 of an aluminum alloy plate, a stainless steel plate, a wood-plastic plate or a PVC plate.

Example 3

Figure 12:
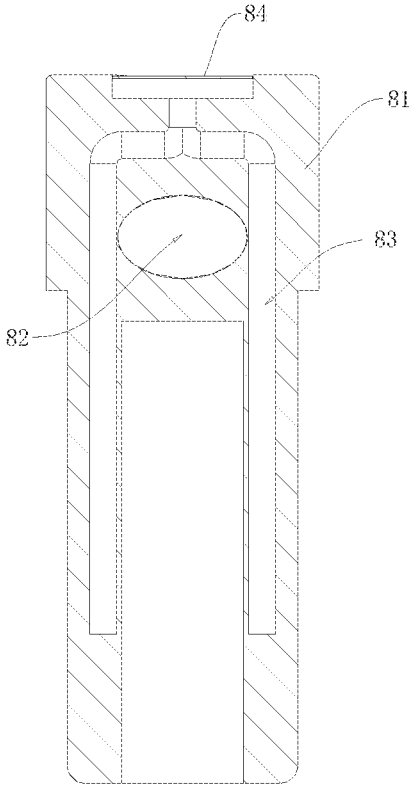
FIG. 12 is a first cross-sectional view of the blocking post provided in Example 3 of the present invention, for showing the elastic airbag in the initial state.
Figure 13:
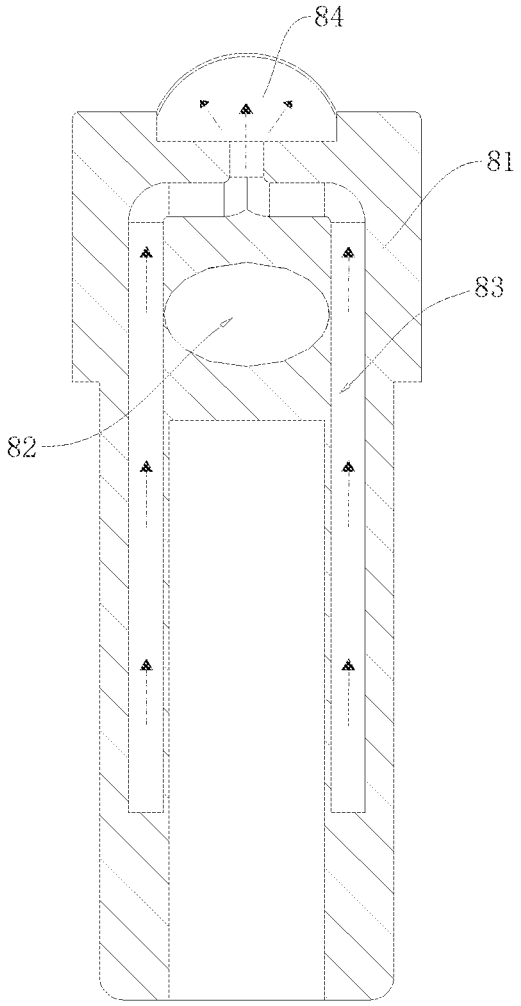
FIG. 13 is a second cross-sectional view of the blocking post provided in Example 3 of the present invention, for showing the elastic airbag in the squeezed state.

Referring to FIG. 12 and FIG. 13, this example is different from Example 2 in that the blocking post 81 is configured with a flow channel 83, and the opening of the flow channel 83 is sealedly attached with an elastic airbag 84 for the air flow in the flow channel 83 when the blocking post 81 is squeezed.

In this example, the elastic airbag 84 may be immobilized to the opening of the flow channel 83 by adhesion. When the blocking post 81 is squeezed by the decking bodies 6 hardly, the blocking post 81 is deformed, thereby causing the gas in the flow channel 83 to rush to the elastic airbag 84, and the elastic airbag 84 becomes bigger and protrudes upwards. In this way, it is beneficial to check the deformation of the current blocking post 81. When the height of the elastic airbag 84 is greater than a preset height, the decking bodies 6 may be replaced or maintained. It should be noted that, in this example, the top of the blocking post 81 is lower than the surface of the decking body 6.

Example 4

Figure 14:
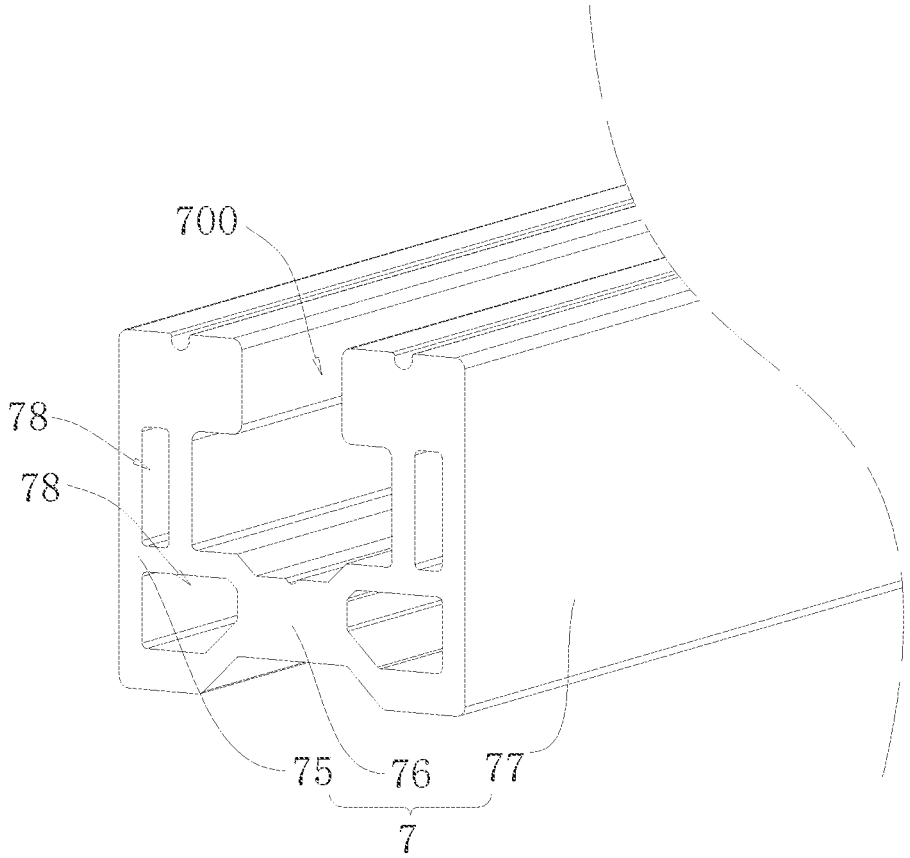
FIG. 14 is a schematic diagram of joist provided in Example 4 of the present invention.

Referring to FIG. 14, this example is different from Example 2 in that the joist 7 comprises a first mounting block 75 and a second mounting block 76 that are configured symmetrically, wherein the first mounting block 75 and the second mounting block 76 are connected via a third mounting block 77;

the first mounting block 75, the second mounting block 76 and the third mounting block 77 surround to form a second snap-in groove 700;

wherein, both the first mounting block 75 and the second mounting block 76 are configured with at least one hollow groove 78.

In this example, the first mounting block 75, the second mounting block 76 and the third mounting block 77 are configured to be integrally molded, thereby improving the structural strength of the joist 7, wherein the hollow groove 78 serves to reduce the weight of the joist 7.

Example 5

Figure 15:
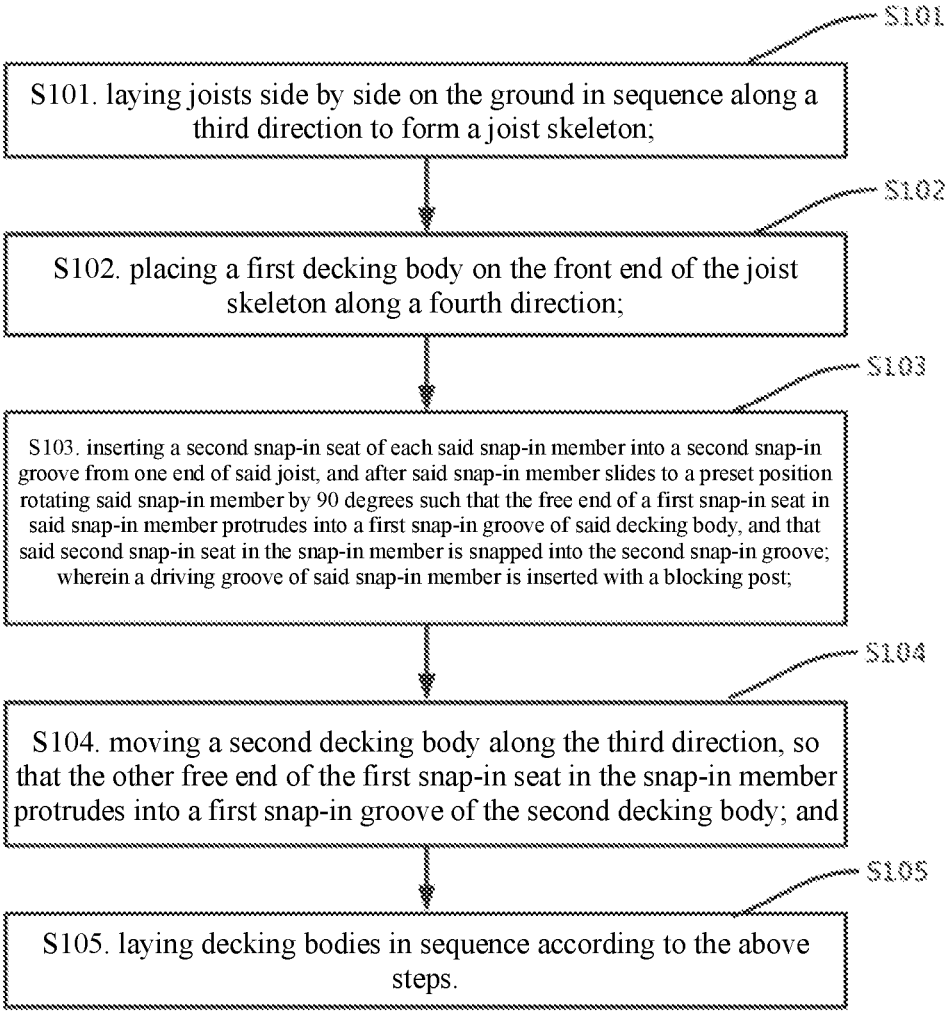
FIG. 15 is a flow chart showing the method of assembling decking provided in Example 5 of the present invention.

Referring to FIG. 15, the present application further provides a method of assembling decking, comprising:

S101. laying joists 7 side by side on the ground in sequence along a third direction 9 to form a joist skeleton;

S102. placing a first decking body 6 on the front end of the joist skeleton along a fourth direction 91;

S103. inserting a second snap-in seat 2 of each snap-in member 100 into a second snap-in groove 700 from one end of the joist 7, and after the snap-in member 100 slides to a preset position rotating the snap-in member 100 by 90 degrees, such that the free end of a first snap-in seat 1 in the snap-in member 100 protrudes into a first snap-in groove 600 of the decking body 6, and that the second snap-in seat 2 in the snap-in member 100 is snapped into the second snap-in groove 700;

wherein a driving groove 12 of the snap-in member 100 is inserted with a blocking post 81;

S104. moving a second decking body 6 along the third direction 9, so that the other free end of the first snap-in seat 1 in the snap-in member 100 is engaged into the first snap-in groove 600 of the second decking body 6; and S105. laying decking bodies in sequence according to the above steps 6.

In this example, a snap-in member 100 is substituted for a screw or a bolt, and effectively improves the efficiency of installation and disassembly of decking bodies 6, wherein, during the disassembly process, the blocking post 81 is first pulled out from the driving groove 12, and then a tool like a wrench is inserted into the driving groove 12: by rotating the wrench the snap-in member 100 is rotated by 90 degrees, the free end of the first snap-in seat 1 is disengaged from the first snap-in groove 600 of the decking body 6, and the second snap-in seat 2 in the snap-in member 100 is no longer snapped into the second snap-in groove 700. After all the snap-in members 100 engaged to the current decking bodies 6 are disengaged according to the above-mentioned operations, the current decking bodies 6 are separated from the corresponding joists 7.

Two adjacent decking bodies 6 are mounted on the same joist 7 only by adjusting the angle of the snap-in member 100, which is simple and easy to operate and effectively improves the efficiency of installation and disassembly of decking bodies 6; moreover, a certain gap spacing 93 is left between decking bodies 6 by mounting two adjacent decking bodies 6 on the same joist 7 using the snap-in member 100; and the snap-in member 100 serves to prevent two adjacent decking bodies 6 from being squeezed with each other, so as to achieve the effect of reducing damages to decking bodies 6.

The above descriptions are only specific embodiments of the present invention, but the protection scope of the present invention is not limited thereto. Any person of ordinary skill in the art would readily conceive of various equivalent amendments or replacements within the technical scope disclosed in the present invention. These amendments or replacements shall all fall within the protection scope of the present invention. Therefore, the protection scope of the present invention should be subject to the appended claims.

What is claimed is:

1. An assembled decking combination, comprising:

at least one snap-in member comprising:

a first snap-in seat, configured to extend along a first direction a second snap-in seat, configured to extend along a second direction, wherein said first direction and said second direction are configured to have an angle of 70-90 degrees;

a connecting base, two ends of which are engaged with one side of said first snap-in seat and one side of said second snap-in seat, respectively;

wherein, the other side of said first snap-in seat is configured with a driving groove for driving rotation of said first snap-in seat, said second snap-in seat and said connecting base;

at least two decking bodies, wherein there is a gap spacing between adjacent decking bodies, and two ends of each said decking body are extendedly configured with a first snap-in groove along the length direction, respectively; and at least one joist, each said joist extendedly configured with a second snap-in groove along the length direction;

a hermetic structure detachably mounted on each said driving groove;

wherein, all said decking bodies are laid on said joists: when said snap-in member is in the snap-in state, said first snap-in seat is snapped into said first snap-in groove, and two ends of said second snap-in seat are snapped into said second snap-in groove, so that said decking bodies are snapped into said joists;

said hermetic structure comprises a blocking post, which is inserted into a respective driving groove and has one end protruding from an opening of said driving groove for sealing said driving groove, and for limiting two adjacent decking bodies.

2. The assembled decking combination according to claim 1, wherein the protruding end of said blocking post is provided with a through hole, and one end of said blocking post substantially abuts against one side of said decking body.

3. The assembled decking combination according to claim 1, wherein said blocking post is configured with a flow channel, and an opening of said flow channel is sealedly attached to an elastic airbag for an air flow in said flow channel when said blocking post is squeezed.

4. The assembled decking combination according to claim 1, wherein said decking bodies are wrapped with a protective layer.

5. The assembled decking combination according to claim 1, wherein said decking bodies are is configured with at least one hollow hole, and one side of said decking bodies facing said joist is configured with a plurality of through grooves.

6. The assembled decking combination according to claim 1, wherein said at least one joist comprises a first mounting frame and a second mounting frame that are configured symmetrically, wherein said first mounting frame and said second mounting frame are connected via a third mounting frame:

said first mounting frame, said second mounting frame and said third mounting frame surround to form said second snap-in groove;

wherein, both said first mounting frame and said second mounting frame are configured with at least one inward concave reinforcement groove.

7. The assembled decking combination according to claim 1, wherein said at least one joist comprises a first mounting block and a second mounting block that are configured symmetrically, wherein said first mounting block and said second mounting block are connected via a third mounting block;

said first mounting block, said second mounting block and said third mounting block surround to form said second snap-in groove;

wherein, both said first mounting block and said second mounting block are configured with at least one hollow groove.

8. The assembled decking combination according to claim 1, wherein said connecting base comprises an abutting part and a connecting part that are engaged with each other, wherein the free end of the connecting part is fixedly engaged with one side of the second snap-in seat, and the free end of the abutting part is fixedly engaged with one side of the first snap-in seat:

wherein, an outer side of said abutting part is configured to substantially abut against the opposite sides of two adjacent decking bodies when the first snap-in seat and the second snap-in seat are in the snap-in state.

9. The assembled decking combination according to claim 8, wherein said abutting part is configured with at least one first through hole penetrating the outer side of said abutting part.

10. The assembled decking combination according to claim 9, wherein two first through holes are symmetrically arranged, and said two first through holes substantially face the opposite sides of the corresponding decking bodies when said first snap-in seat and said second snap-in seat are in the snap-in state.

11. The assembled decking combination according to claim 9, wherein each of said first through holes comprises the following parts that all penetrate the two sides of said abutting part:

a first communication part;

a second communication part, communicated with said first communication part; and a third communication part, communicated with said first communication part and said second communication part, and positioned between said first snap-in seat and said abutting part;

wherein, said first communication part and said third communication part are also communicated with the outer side of said abutting part, and the volume of said first communication part is smaller than that of said second communication part.

12. The assembled decking combination according to claim 8, wherein two ends of said second snap-in seat in the second direction are configured with deformation structures, respectively, which are used to be snapped into said second snap-in seat and said joist in the snap-in state.

13. The assembled decking combination according to claim 12, wherein each of said deformation structures comprises at least one elastic piece, one end of the elastic piece securely engaged on one end of the second snap-in seat, and between the other end of said elastic piece and the end face of said second snap-in seat being a deformation spacing.

14. The assembled decking combination according to claim 13, wherein each of said deformation structures comprises two symmetrically arranged elastic pieces, said elastic piece configured in an arc shape and provided with an abutting platform on the outer side.

15. The assembled decking combination according to claim 1, wherein one side of said first snap-in seat facing away from said second snap-in seat is provided with an arched guide face, and one side of said first snap-in seat facing said second snap-in seat is provided with an outward arc face.

16. The assembled decking combination according to claim 1, wherein geometric centerlines of said first snap-in seat, said connecting base and said second snap-in seat coincide;

and said first snap-in seat, said connecting base and said second snap-in seat are communicatively configured with a through hole, which is coaxially communicated with said driving groove.

17. A method of assembling decking for assembling said assembled decking combination of claim 1, comprising:

laying said joists side by side on a ground in sequence along a third direction to form a joist skeleton;

placing a first decking body of said decking bodies on a front end of said joist skeleton along a fourth direction;

inserting said second snap-in seat of each said snap-in member into said second snap-in groove from one end of one of said joists, and after said snap-in member slides to a preset position rotating said snap-in member such that a free end of said first snap-in seat in said snap-in member protrudes into said first snap-in groove of said decking body, and that said second snap-in seat in said snap-in member is snapped into said second snap-in groove: wherein said driving groove of said snap-in member is inserted with said blocking post;

moving a second decking body of said decking bodies along the third direction, so that the other free end of said first snap-in seat in said snap-in member protrudes into said first snap-in groove of said second decking body of said decking bodies; and laying additional decking bodies in sequence according to the above steps.

* * * * *